United States Patent [19]

Izraeli

[11] Patent Number: 4,461,527

[45] Date of Patent: Jul. 24, 1984

[54] INSULATION DISPLACING TERMINAL

[75] Inventor: Hyman Izraeli, West Caldwell, N.J.

[73] Assignee: Thomas & Betts Corporation, Raritan, N.J.

[21] Appl. No.: 335,378

[22] Filed: Dec. 29, 1981

[51] Int. Cl.[3] ..... H01R 11/20

[52] U.S. Cl. ..... 339/97 R; 339/97 P

[58] Field of Search ..... 339/97 R, 97 C, 97 P, 339/98, 99 R

[56] References Cited

U.S. PATENT DOCUMENTS

| | | | |
|---|---|---|---|
| 3,064,072 | 11/1962 | Graff et al. | 174/87 |
| 3,320,354 | 5/1967 | Marley et al. | 339/97 C |
| 3,553,347 | 1/1971 | Bushey et al. | 174/84 |
| 3,758,703 | 9/1973 | Golden et al. | 174/84 |
| 3,826,861 | 7/1974 | Karl et al. | 339/98 |
| 3,829,822 | 8/1974 | Geiser et al. | 339/98 |
| 3,842,191 | 10/1974 | Neale, Sr. | 174/88 |
| 3,868,475 | 2/1975 | Allison | 174/87 |
| 3,878,318 | 4/1975 | Ziegler, Jr. et al. | 174/94 |
| 3,881,796 | 5/1975 | Saunders | 339/97 |
| 3,899,236 | 8/1975 | Santos | 339/98 |
| 3,937,403 | 2/1976 | Lawson | 339/97 |
| 3,950,064 | 4/1976 | Kuo | 339/97 |
| 3,960,430 | 6/1976 | Bunnell et al. | 339/97 |
| 3,964,815 | 6/1976 | McDonough | 339/97 |
| 4,106,836 | 8/1978 | Asick et al. | 339/97 |
| 4,326,767 | 4/1982 | Silbernagel et al. | 339/98 |

FOREIGN PATENT DOCUMENTS

| | | | |
|---|---|---|---|
| 2253290 | 6/1975 | France | 339/98 |

*Primary Examiner*—John McQuade
*Assistant Examiner*—Paula Austin
*Attorney, Agent, or Firm*—Robert M. Rodrick; Salvatore J. Abbruzzese

[57] ABSTRACT

An insulation displacing terminal for making electrical contact with the conductor of an insulated cable. The terminal has a body portion including lancing members for piercing the insulation and contacting the conductor of the cable. An outer housing receives the terminal body portion and upon crimping forces the cable downwardly upon the lancing members.

5 Claims, 10 Drawing Figures

INSULATION DISPLACING TERMINAL

FIELD OF THE INVENTION

This invention relates to insulation displacing electrical terminals and more particularly to a terminal having a deformable member which forces the insulated wire against an insulation piercing receptacle.

BACKGROUND OF THE INVENTION

In terminating insulated wire, it is often necessary that the insulation at the end of a wire be stripped away to expose the conductor to insure a good connection. The problems and limitations associated with insulation stripping are well known. It is a time-consuming task, requiring special tools. Further, after stripping, the wire must be inspected to insure complete exposure. Moreover, stripping may result in damage to the conductor, thereby decreasing the efficiency of the electrical connection.

In addition to the familiar problems associated with wire stripping, newly-developed insulation products such as, for example, those sold under the tradenames KYNAR and KAPTON and the like present new problems in insulation stripping. KAPTON, for example, is difficult to strip, as a thin layer of insulation is deposited about the conductor, which cannot be sufficiently removed by conventional stripping techniques. This thin outer coating will prevent complete electrical connection. Also, since the properties of these new insulation materials permit thinner insulation wall thicknesses, "funnel entry" type animals, known in the art, would be difficult to employ. These type connectors allow the stripped end to enter or funnel into a crimping zone in the connector while keeping out the insulated portion. It would be difficult to construct a "funnel entry" type terminal to such precise dimensions so as to keep out the thin-walled insulation material.

The art has also seen attempts at providing insulation piercing terminals. Many of these terminals in addition to requiring crimping for electrical connection require further steps for providing strain relief to prevent the wire from being pulled out of the terminal. In addition, locating the wire in the terminal to insure proper piercing of the insulation often becomes a problem, as many of the prior devices fail to provide suitable guides to align the conductor over the contact. Such crimping may often cause the contact to miss the conductors and thereby render the electrical connection ineffective.

SUMMARY OF THE INVENTION

It is an object of the present invention to provide an improved insulation displacing electrical terminal.

It is a further and more particular object to provide a terminal that securely and completely provides mechanical and electrical connection to an unstripped insulated conductor.

In the attainment of the foregoing and other objects the invention looks toward providing an electrical terminal for connecting an insulated conductor comprising a body portion having insulation piercing members thereon and a housing removably receiving the body portion. A deformable portion of the housing is movable from a position above the insulation piercing members to a position below the insulation piercing members.

In the particular embodiment shown and described herein, the invention provides an electrical terminal having a body portion including a plurality of lancing members extending up from a base portion. An outer housing receives the body portion and serves to locate the insulated wire in position over the lancing members. Crimping of the housing will force the insulated wire down upon the lancing member, thereby establishing electrical contact between the terminal and the conductor. The housing may be crimped below the lancing edge of the lancing members to insure complete electrical connection and to provide adequate strain relief.

DETAILED DESCRIPTION OF PREFERRED EMBODIMENTS

Figure 1:
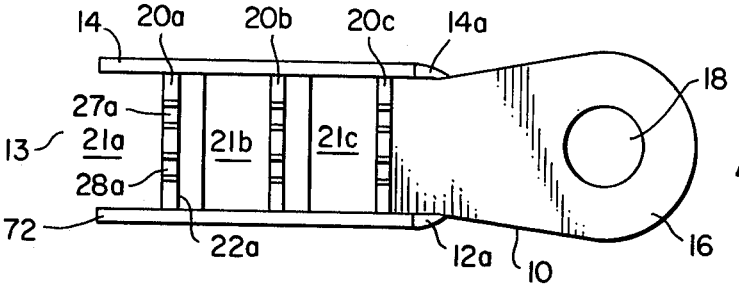
FIGS. 1–3 are top, side and end elevational views respectively of the body portion of the terminal of the present invention.

The electrical terminal of the present invention is shown by way of a preferred embodiment having two interlocking components: a body portion 10 and a sleeve 50 which slidably receives the body portion. The terminal is constructed to engage an insulated cable 80 containing a pair of parallel, spaced-apart conductors 81 and 82. The present invention will be described with reference to the twin conductor terminal shown in the drawings presented herewith, but is not limited to this particular embodiment. It is contemplated that a terminal within the scope of the present invention can be constructed to receive an insulated cable containing one or more conductors. It is further contemplated that the present invention may be used to connect to each other, in either side by side or end to end relation, two or more insulated cables.

Figure 2:
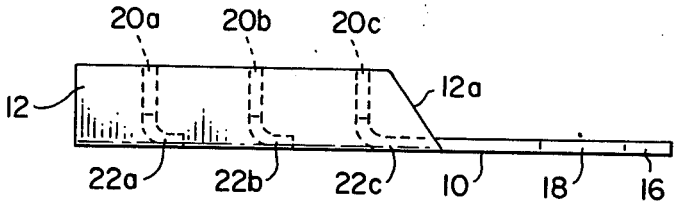
Figure 3:
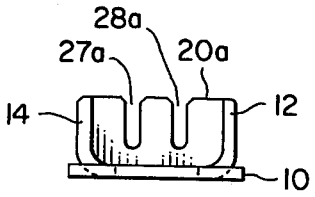

Referring now to FIGS. 1–3, body portion 10 has a pair of parallel, spaced-apart side walls 12 and 14 defining therebetween an elongate cable receiving channel 13. Each of side walls 12 and 14 are rigid, flat planar members, substantially rectangular, having a lengthwise extent and height. One of each of the opposing edges **12*a* and 14*a* of side walls 12 and 14 is inclined so that the length of walls 12 and 14 is greater at their base than at their height. Side walls 12 and 14 are constructed of sufficient strength so as to support, without bending, a cable 80 which is to be inserted therethrough for ultimate crimping with a low-insertion force tool. A flat mounting surface 16 extends outwardly from wire receiving channel 13, at the base of the inclined end of side walls 12 and 14, substantially perpendicularly therefrom. Mounting surface 16 includes a centrally located mounting aperture 18**, which may be used to connect the assembly to an electrical enclosure or similar structure. An aperture is shown only by way of example, it being understood that any mounting means can alternately be employed.

Transversely spanning elongate cable receiving channel 13 between the side walls 12 and 14 are three parallel, spaced-apart insulation lancing members 20*a*, 20*b* and 20*c*. Each lancing member is positioned across the channel with lancing member 20*b* being centrally located and flanked on each side by lancing members 20*c* and 20*a*, positioned interiorly of the ends of elongate channel 13. In the preferred construction, the lance members are each struck by conventional methods from the base of the body portion 10 leaving adjacent to each lance member 20*a*–20*c* an associated opening 21*a*, 21*b*, and 21*c*, respectively. As each of the lancing members 20*a*–*c* are substantially similar, descriptive reference will be made with respect to member 20*a*, with like reference numerals denoting like elements of members 20*b* and 20*c*.

Lancing member 20*a* has a base portion 22*a*, which extends between the base of side walls 12 and 14. A flat wall portion 24*a* extends upwardly, substantially perpendicular to both side walls 12 and 14. The upper edge of wall portion 24*a* is preferably planar or flush with the upper ends of walls 12 and 14, and forms a lancing surface 26*a* therebetween. Downwardly extending from and communicating with the lancing surface 26*a* is a pair of spaced-apart, generally U-shaped conductor receiving slots 27*a* and 28*a*. The upper edge of each slot 27*a*–*c* has a wider entry portion to facilitate conductor reception and provide superior insulation displacing qualities along lancing surface 26*a*–*c*. Slots 27*a*–*c* of lancing member 20*a*–*c* are colinear in the body portion 10 as are slots 28*a*–*c*, so as to form a pair of parallel spaced-apart conductor receiving channels within cable receiving channel 13. The conductor receiving channels will receive and electrically contact the conductors 80 and 81 of the pierced insulated cable 80 as to be described hereinafter.

Figure 4:
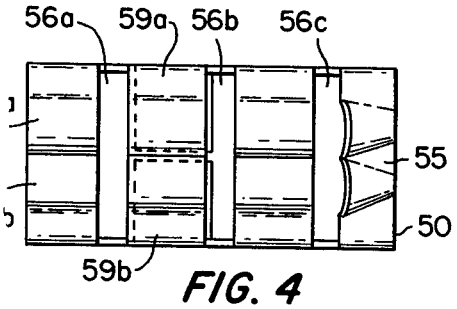
FIGS. 4–6 are top, side and end elevational views respectively of the sleeve of the terminal of the present invention.
Figure 5:
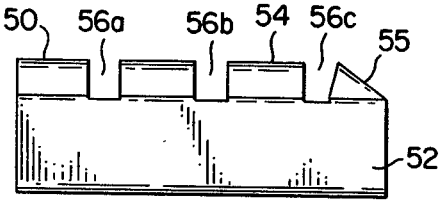
Figure 6:
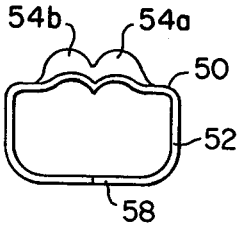

Constructed to slidably engage and circumscribe body portion 10 is sleeve 50 shown in detail in FIGS. 4–6. Sleeve 50 is generally an elongate tubular member having a shape as shown in FIG. 6 which includes rectangular lower portion 52 and an undulating upper portion 54. Upper undulating portion 54 includes a pair of arcuately configured, deformable elongate ridges 54*a* and 54*b*, which preferably extend the entire length of the sleeve. Elongate ridges 54*a* and 54*b* are spaced apart to correspond to the spacing of the U-shaped slots 27*a*–*c* and 28*a*–*c* of body portion 10. One end of upper portion 54, which corresponds to inclined ends 12*a* and 14*a* of side wall 12 and 14, when the assembly is engaged, is tapered inwardly to form a tapered stop surface 55, which is provided to locate the inserted conductor 80 in proper position. Tapered end surface 55 also forms a wedge surface to securely receive the inserted cable in the engaged assembly prior to crimping, as will be described hereinafter. Also, upper portion 54 includes three transverse slots 56*a*, 56*b* and 56*c* which are spaced apart to correspond to the spacing of lancing members 20*a*–*c* of body portion 10.

Figure 7:
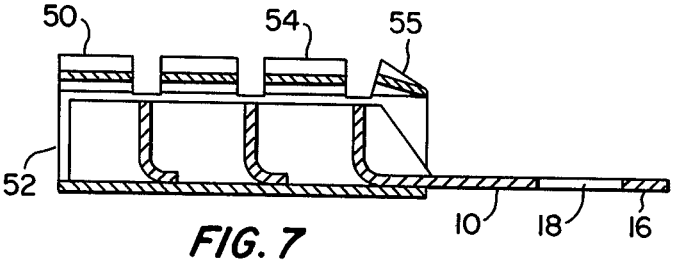
FIG. 7 is a longitudinal sectional view of the assembled terminal including the body portion and sleeve locked therearound.

The bottom surface 58 of lower portion 52 includes a pair of oppositely facing locking tabs 59*a* and 59*b*, which are hingedly secured to the side walls of lower portion 52 to bend upwardly to form a catch which will prevent the disconnection of the engaged assembly. In engaged position locking tabs 59*a* and 59*b* will bend up between lancing members 20*a* and 20*b* as shown iN FIGS. 4 and 7.

With the structure of the body portion 10 and sleeve 50 described, the assembly of the terminal is described with reference made to FIGS. 7–10. Body portion 10 is shown inserted into sleeve 50 so that inclined ends 12*a* and 14*a* of side walls 12 and 14 are adjacent tapered end 55 of sleeve 50. Locking tabs 59*a* and 59*b* are bent upwardly through base opening 21*b* and against side walls 12 and 14, between lancing members 20*b* and 20*c*. In this locked position transverse slots 56*a*–*c* are aligned with lancing members 20*a*–*c*; and elongate ridges 54*a* and 54*b* extend in registry over the contact receiving channels formed by U-shaped slots 27*a*–*c* and 28*a*–*c*. The assembly may be covered by a dielectric cover such as tape which is preferably transparent for visibility, which insulates the components.

Figure 8:
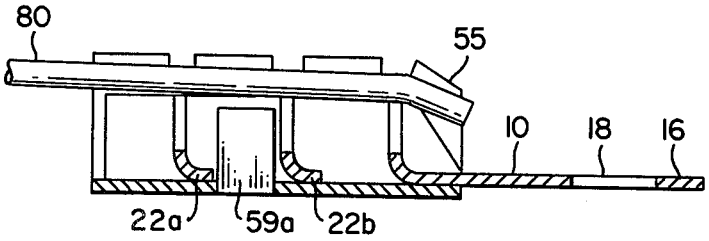

Insulated cable 80 may then be inserted into the assembly through upper portion 54 of sleeve 50, over transverse lancing member 20*a*–*c*. Elongate ridges 54*a* and 54*b* will accommodate the conductors 81 and 82, aligning and guiding them over U-shaped slots 27*a*–*c* and 28*a*–*c*. Tapered end surface 55 of sleeve 50 serves as a stop to assure suitable insertion of cable 80, and additionally serves to wedge the inserted cable therein to secure registration prior to the crimping operation. Such retention is useful during connection and insulation to prevent the cable from dislodging from the yet uncrimped assembly. As shown in FIG. 8, the cable is in place over the lancing member with the cable end wedged in the tapered surface 55 of the sleeve.

With the cable inserted as described above, the terminal assembly can now be crimped to provide proper connection. A low-insertion force tool of the types well-known in the art may be used. Crimping will drive the bendable upper portion 54 of sleeve 50 and thereby the cable inwardly, below the plane of the cutting edges 26*a*–*c* of lancing members 20*a*–*c*. Slots 56*a*–*c* accommodate the upwardly extending lancing member permitting the upper portion 54 of sleeve 50 to be sufficiently crimped downwardly. By such crimping of the upper portion 54, cable 80 will be forced against cutting edges 26*a*–*c* of lancing member 20*a*–*c*, thereby piercing the insulation. As the upper portion is forced further downward, conductors 81 and 82 (shown in FIG. 10) will be forced into the U-shaped slots 27*a*–*c* and 28*a*–*c*, thereby making electrical contact therein. The outer edge of the sleeve 50 (i.e., the end opposite tapered end surface 55) may be crimped further down forcing cable 80 in a lower position externally of lancing member 20*c*. This excessively crimped portion of cable 80 provides sufficient strain relief as the sharp kink in the cable, formed as it winds around and over the first lancing member 20*c*, reduces the possibility of stress, particularly torsional stress from being propagated to the connection points.

Figure 9:
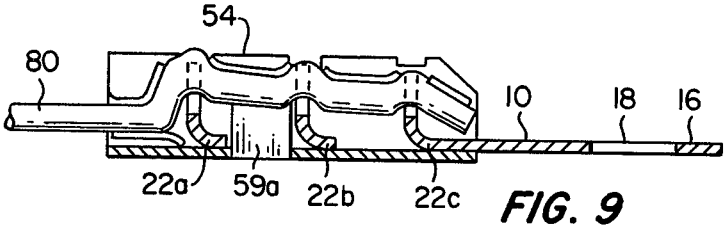
FIGS. 8 and 9 are views of the assembled terminal of FIG. 7 including an insulated conductor cable and shown in uncrimped and crimped positions respectively.
Figure 10:
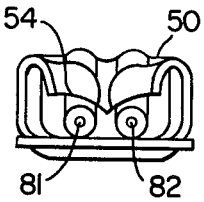
FIG. 10 is an end elevational showing of the assembled terminal including insulated conductor cable of FIG. 9.

It is contemplated that to provide maximum electrically conductive capabilities, while insuring structural strength, the cable is preferably crimped downwardly progressively deeper toward the mounting surface. As shown in FIGS. 9 and 10, conductors 81 and 82 of cable 80 are displaced just slightly below cutting edge 26*c* of lancing member 20*c*. This will prevent conductor severing at this contact point. The conductors are pushed further down in lancing member 20*b* and still further in lancing member 20*a*. The deeper insertion will enhance electrical conductivity, while providing mechanical securement.

The particularly preferred disclosed embodiments and practices are intended in a descriptive sense and are not limiting. The scope of the invention is set forth in the following claims.

What is claimed is:

1. An electrical terminal for connecting an insulated cable including at least one conductor therein comprising:

a body portion defining an elongate channel having an open upper end;

at least one member transversely spanning said channel, said member including an upper insulation piercing surface and at least one conductor receiving slot commensurate with said piercing surface; and an elongate sleeve removably receiving said body portion, said sleeve having a lower portion receiving said elongate channel and a bendable upper portion covering said open upper end of said channel and thereby providing an opening for receiving said insulated cable therein, said upper portion being bendable from a first position above said piercing surface to a second position below said piercing surface, said bendable upper portion further includes at least one transverse opening in registry with said at least one member, for receiving said member upon movement of said upper bendable portion from said first position to said second position.

2. The terminal in accordance with claim 1 wherein said elongate sleeve includes an end surface for contacting one end of said insulated cable.

3. The terminal in accordance with claim 1 including a pair of locking tabs, extending upwardly from a lower surface of said elongate sleeve, said locking tabs disposed to engage said body portion to thereby lock said body portion in said sleeve.

4. The terminal in accordance with claim 1 including strain relief means for securing said cable in said terminal.

5. The terminal in accordance with claim 4 wherein said strain relief means includes said upper portion of said sleeve.

* * * * *